US006955362B2

(12) United States Patent
Bazzi

(10) Patent No.: US 6,955,362 B2
(45) Date of Patent: Oct. 18, 2005

(54) BINDING FOR COUPLING A SHOE TO A SNOWBOARD AND THE LIKE

(75) Inventor: Giuseppe Bianchi Bazzi, Colico (IT)

(73) Assignee: Twinex S.R.L., Delebio (IT)

( * ) Notice: Subject to any disclaimer, the term of this patent is extended or adjusted under 35 U.S.C. 154(b) by 0 days.

(21) Appl. No.: 10/839,234

(22) Filed: May 6, 2004

(65) Prior Publication Data

US 2004/0262887 A1 Dec. 30, 2004

(30) Foreign Application Priority Data

Jun. 25, 2003 (IT) ..... MI2003A1294

(51) Int. Cl.[7] ..... B62B 9/04
(52) U.S. Cl. ..... 280/14.22; 280/624; 280/613
(58) Field of Search ..... 280/613, 624, 280/633, 634, 14.21, 14.22, 14.23, 617, 619, 280/621, 622, 623

(56) References Cited

U.S. PATENT DOCUMENTS 5,556,123 A * 9/1996 Fournier ..... 280/14.24
5,692,765 A 12/1997 Laughlin
5,727,797 A * 3/1998 Bowles ..... 280/14.21
5,909,886 A * 6/1999 Tugutaka et al. ..... 280/14.21
6,007,077 A 12/1999 Moe
6,027,136 A * 2/2000 Phillips ..... 280/618
6,364,323 B1 * 4/2002 Coulter ..... 280/14.22
6,464,237 B1 * 10/2002 Gracie ..... 280/14.24
6,554,295 B2 * 4/2003 Rittmeyer ..... 280/14.22
6,726,238 B2 * 4/2004 Poscich ..... 280/14.22

FOREIGN PATENT DOCUMENTS

DE 44 16 023 C1 10/1995

* cited by examiner

*Primary Examiner*—Hau Phan
(74) *Attorney, Agent, or Firm*—Guido Modiano; Albert Josif; Daniel O'Byrne

(57) ABSTRACT

A binding for coupling a shoe to a snowboard and the like, comprising a base plate that can be fixed to a snowboard and the like and supports a front band, a rear band and a rear spoiler, fastenable onto a shoe, an interconnection being provided for connecting the spoiler and the front and rear bands for positioning in an open position, in which the bands are raised, with the rear spoiler in a lowered position for insertion of the shoe, and for positioning in a closed position, in which the bands are fastened onto the shoe, with the rear spoiler in the raised position.

13 Claims, 5 Drawing Sheets

BINDING FOR COUPLING A SHOE TO A SNOWBOARD AND THE LIKE

The present invention relates to a binding for coupling a shoe to a snowboard and the like.

BACKGROUND OF THE INVENTION

As is known, several kinds of bindings for coupling a shoe to a snowboard are already commercially available and are produced according to the most disparate functional and constructive criteria.

Among conventional solutions, mention is made of those provided with a base element, to which a front band and a rear band are connected, and a rear quarter or spoiler, which is mounted so that it can oscillate with respect to the base, so as to be lowered in order to facilitate shoe insertion.

In the conventional solutions it is necessary to perform separate actuations to lock the spoiler and the front and rear bands that retain the foot, so that during opening or closure of the binding it is necessary to perform a relatively troublesome operating sequence.

Another problem is further constituted by the fact that when the binding is opened, the preset adjustments are lost, with the need to restore the various adjustments at each successive closure operation.

SUMMARY OF THE INVENTION

The aim of the invention is to eliminate the drawbacks noted above, by providing a binding for coupling a shoe to a snowboard and the like that allows to drastically simplify the opening and closure operations, allowing to perform them with a single actuation.

Within this aim, an object of the invention is to provide a binding in which it is possible to store the preset adjustments without losing them upon opening.

Another object of the present invention is to provide a binding in which it is very easy to insert the shoe by virtue of the movement assumed by the various elements that constitute the boot.

Another object of the present invention is to provide a binding for coupling a shoe to a snowboard and the like that thanks to its particular constructive characteristics is capable of giving the greatest assurances of reliability and safety in use.

This aim and these and other objects that will become better apparent hereinafter are achieved by a binding for coupling a shoe to a snowboard and the like, according to the invention, comprising a base plate that can be fixed to a snowboard and the like and supports a front band, a rear band and a rear spoiler, which can be fastened onto a shoe, characterized in that it comprises means for connecting said spoiler and said front or rear bands for positioning in an open position, in which said bands are in a raised position, with said rear spoiler in a lowered position for the insertion of said shoe, and for positioning in a closed position, in which said bands are in a position in which they are fastened onto said shoe, with said rear spoiler in the raised position.

BRIEF DESCRIPTION OF THE DRAWINGS

Further characteristics and advantages of the invention will become better apparent from the description of a preferred but not exclusive embodiment of a binding for coupling a shoe to a snowboard and the like, illustrated by way of non-limiting example in the accompanying drawings, wherein.

DESCRIPTION OF THE PREFERRED EMBODIMENTS

Figure 1:
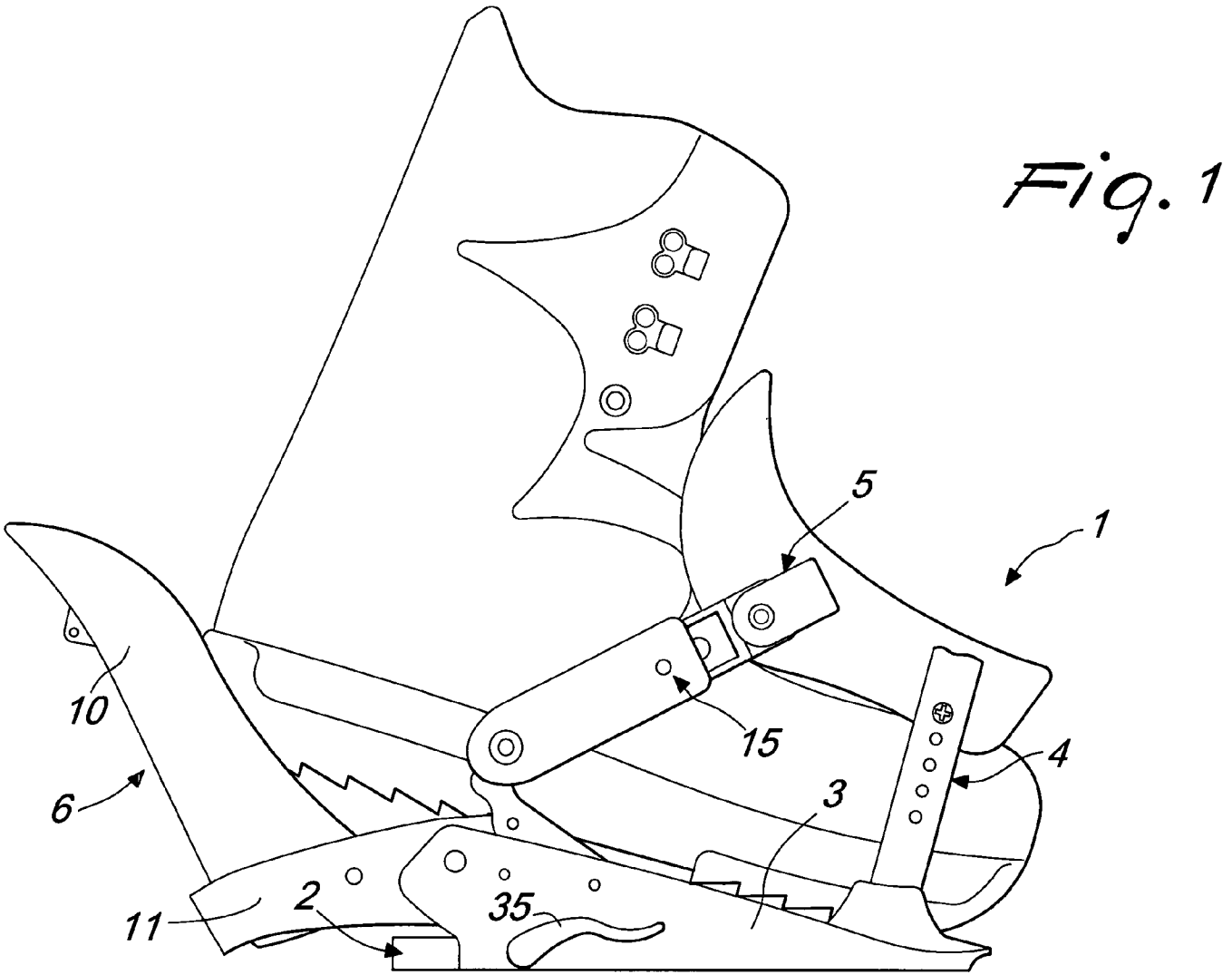
FIG. 1 is a schematic side elevation view of the binding during shoe insertion.
Figure 2:
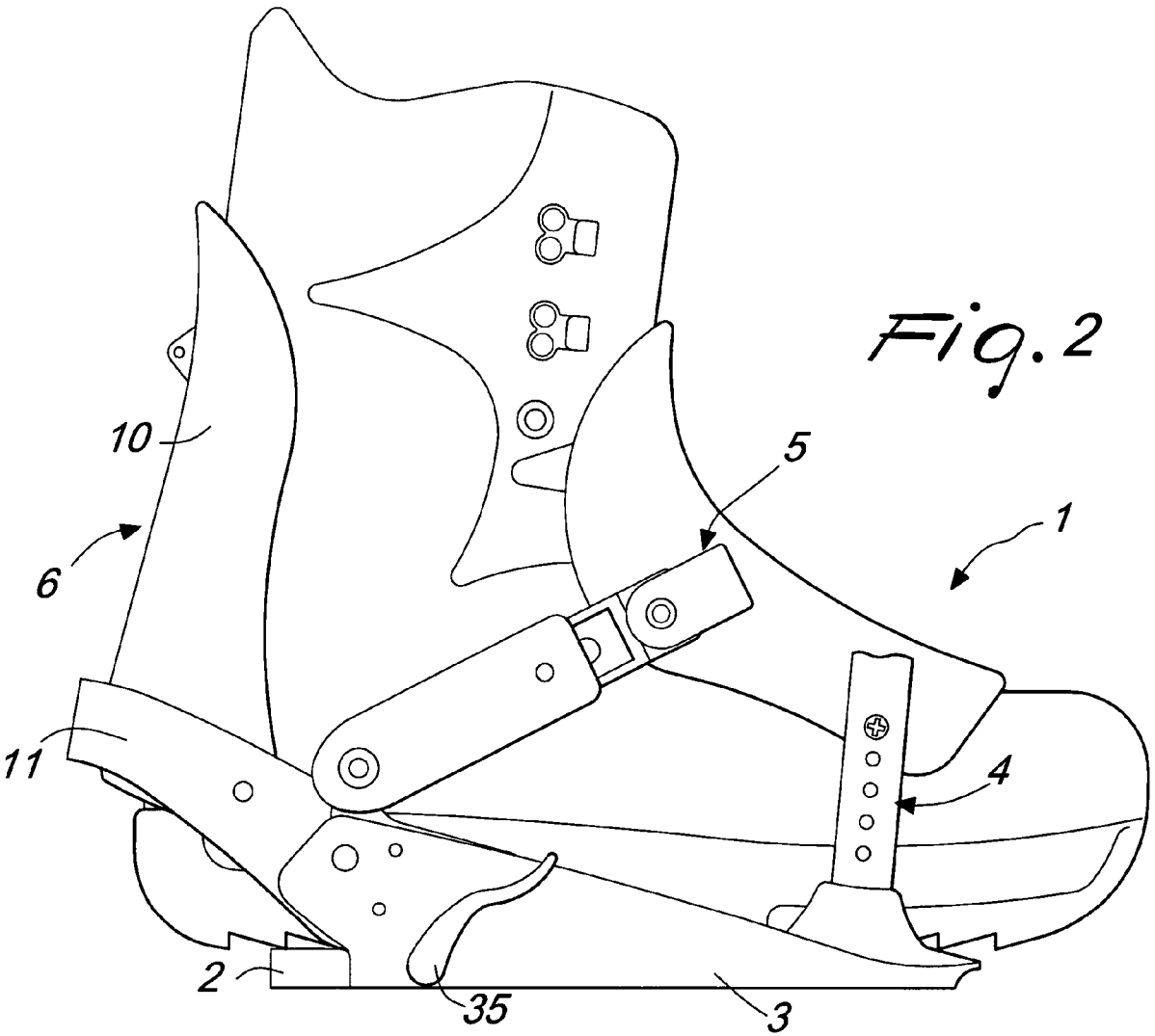
FIG. 2 is a side elevation view of the binding in the position for closing onto a shoe.
Figure 3:
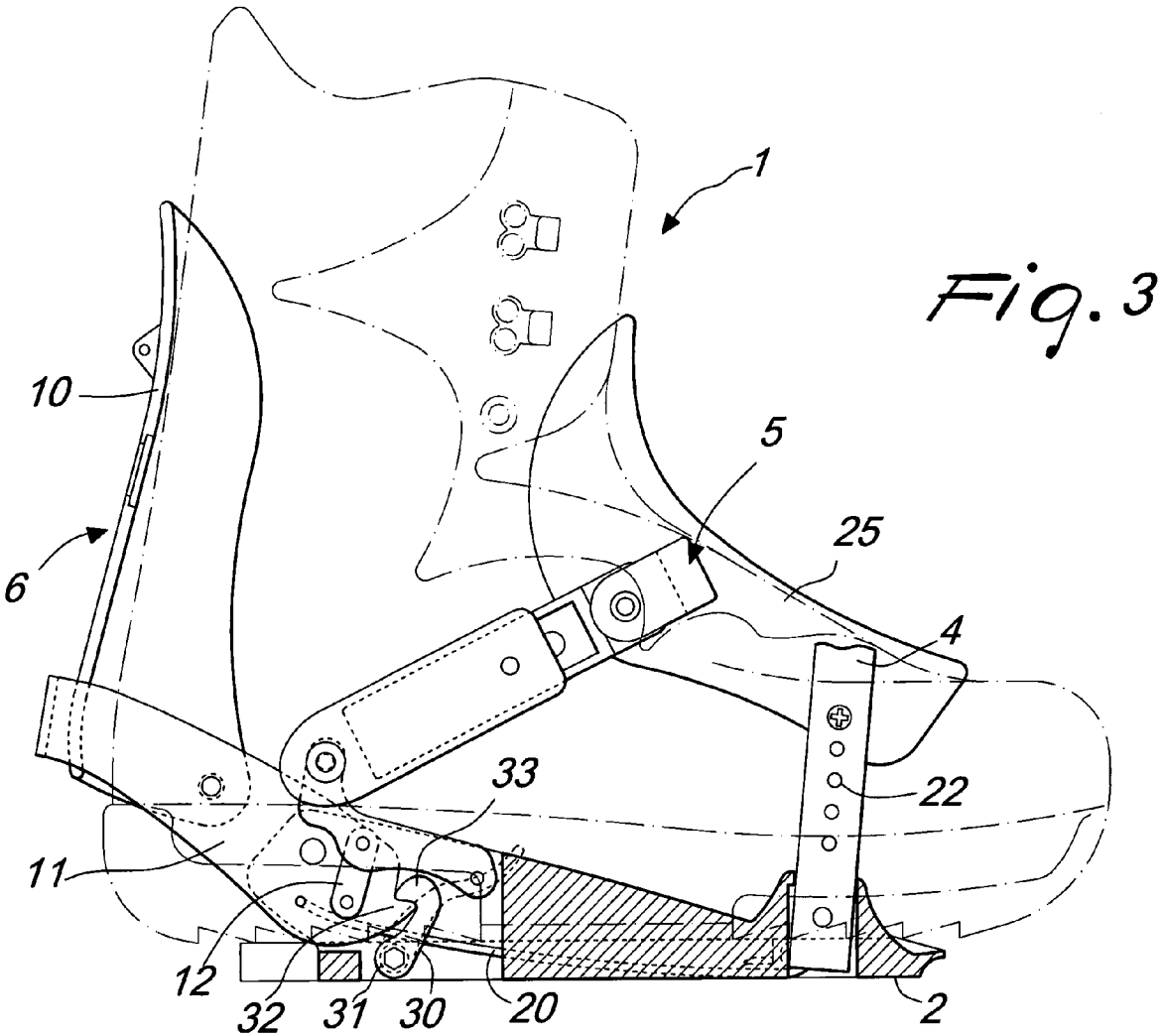
FIG. 3 is a partially sectional view of the binding during the insertion of the shoe.
Figure 4:
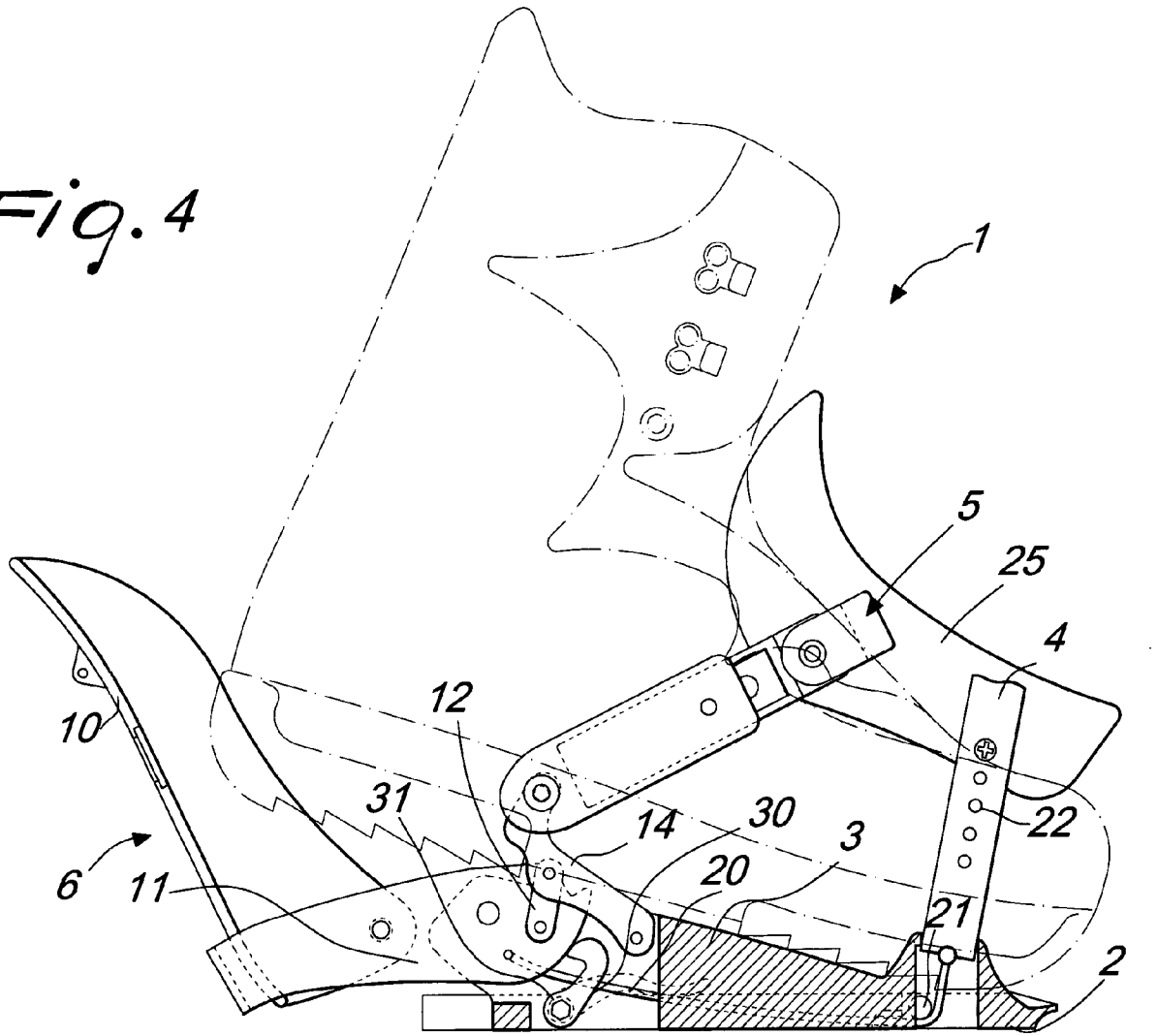
FIG. 4 is a partially sectional view of the binding closed onto a shoe.

With reference to the figures, the binding for coupling a shoe to a snowboard and the like, generally designated by the reference numeral 1, comprises a base plate 2, which typically has a substantially anatomically-shaped configuration in which the rear part, at the heel, is narrower than the front part for accommodating the toe of the foot.

The base plate 2 has lateral shoulders 3, to which a front band 4, arranged at a region of the shoe that corresponds to the toe of the foot, a rear band 5, arranged at a region of the shoe that corresponds to the foot instep, and a rear spoiler 6, located to the rear, are connected.

The particularity of the invention consists in that interconnection means are provided for connecting the spoiler 6 and the bands 4 and 5, which allow, by virtue of a single movement, to achieve both the fastening closure and the opening of the bands 4 and 5, which are correlated to the position of the spoiler 6.

In greater detail, the rear spoiler 6 has a quarter 10, which is pivoted at its rear end to an element of the heel 11, which in plan view is substantially U-shaped, and is pivoted to the rear part of the shoulders 3.

The heel element 11 is articulated by means of a strip or linkage 12, pivoted at the opposite end in the central portion of a fastening element 14, which is pivoted at a first end thereof to the corresponding shoulder 3 and, at the second, other end thereof, to an end of the rear band 5, being part of said interconnection means.

The rear band 5 is provided with length adjustment means 15, which allow the user to preset the useful length of said band, thus adjusting the fastening action in the closed position.

Connection to the fastening element 14, which is arranged on both sides of the rear band 5, causes the rear band to be moved toward the foot instep along a combined direction, that is substantially perpendicular to said shoe instep region, so that a precise fastening without sliding of any kind is achieved, since a downward movement and a movement toward the rear part are achieved simultaneously.

The front band 4 is connected to the heel element 11 by way of a traction cable 20, which is part of said interconnection means and which is connected to the front end of the heel element 11 and winds around a guiding element 21, so as to connect to the end of the band 4 that is provided with means for adjusting the useful length, which are constituted for example by a plurality of holes 22 that allow to adjust the useful length.

The connection is such that when the quarter oscillates during closure, the traction cable 20 is taken up and is consequently subjected to traction.

For the sake of completeness in description, it should be noted that the front and rear bands 4 and 5 are preferably connected to a front presser 25, which engages the front upper part of the foot.

In order to retain the spoiler in the locking position, pawls 30 are provided, which are elastically propelled by elastic means constituted, in particular, by a coiled spring 31, which keeps the pawls, arranged on both sides of the base plate, in contact with the front end of the heel element 11 that is provided with a complementary engagement tooth 32, which engages with a snap action the tooth 33 formed by the pawl 30 when the spoiler is in the raised or closed position.

The binding is laterally provided with a release or engagement lever 35, which allows during opening to disengage the tooth 33 from the complementary tooth 32.

Advantageously, there are means for adjusting the inclination of the rear spoiler, which are connected between the quarter 10 and the heel element 11.

Said adjustment means are constituted for example by a toggle lever 40, which is connected between a base 41 that is rigidly coupled to the rear quarter 10 and a positioning block 42, which can be fixed in an adjustable position with respect to a plate 43 that is rigidly associated with the element 11.

Figure 6:
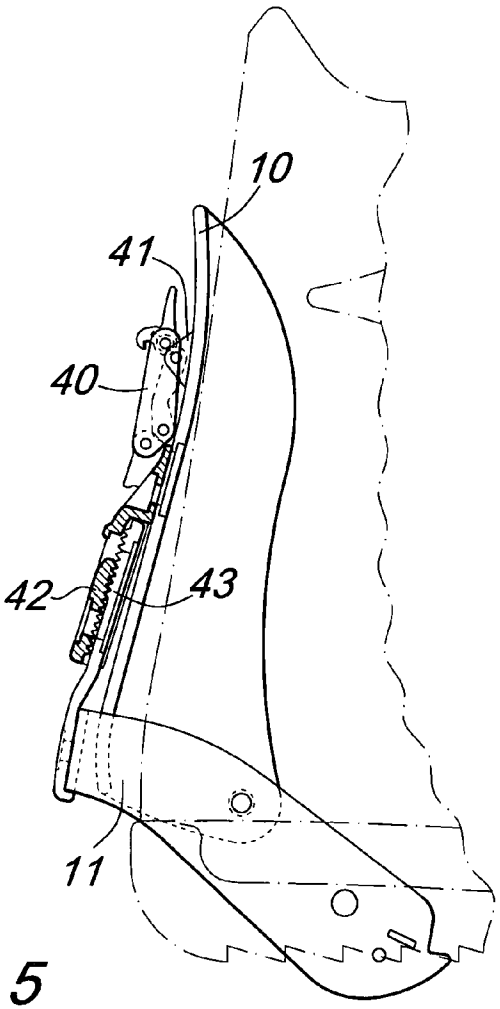
FIGS. 5 and 6 are partially sectional views of the means for adjusting the inclination of the rear spoiler in two different operating positions.
Figure 5:
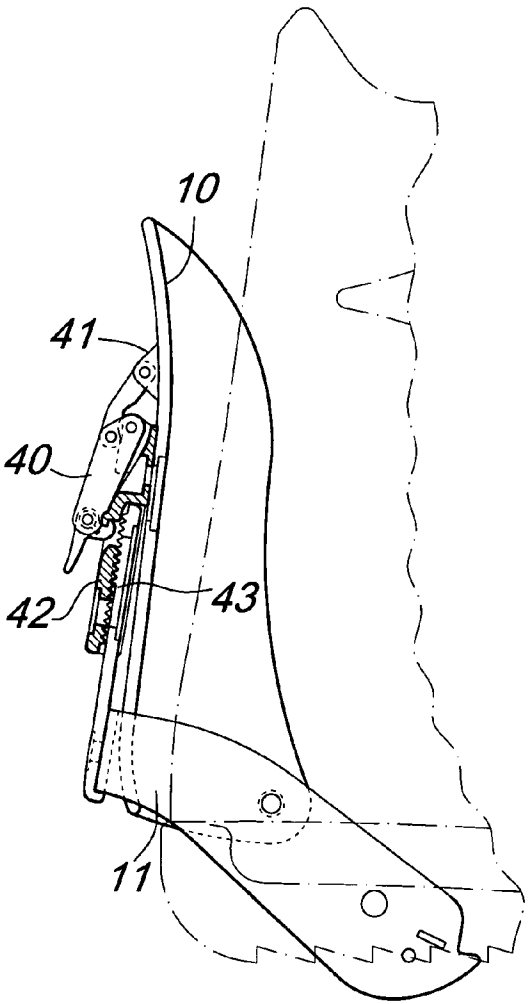

With the described arrangement, it is therefore possible to vary the position of the block 42 with respect to the plate 43 in order to vary the inclination, and it is also possible to perform a further fastening of the quarter by acting on the toggle lever 40, which in the raised position, as shown in FIG. 6, propels the spoiler into the front position.

From what has been described above it is therefore evident that the invention achieves the intended aim and objects, and in particular the fact is stressed that a binding for connecting a shoe to a snowboard and the like is provided which allows to achieve simultaneous closure of the front band and rear band simply by performing the step of lifting the rear spoiler, which is kinematically connected so as to actuate both bands simultaneously.

Moreover, it should be noted that both bands, i.e., the front band and the rear band, during fastening, apply a force that is substantially perpendicular to the engagement region, i.e., the toe region for the front band 4 and the instep region for the rear band 5.

Furthermore, the mechanisms used allow to keep the preset fastening adjustments unchanged during opening, since opening is performed simply by rotating the spoiler, without compromising or modifying the other set adjustments.

Moreover, an important aspect is constituted by the fact that during opening the spoiler automatically lifts the bands, thus making foot insertion particularly quick and easy.

The invention thus conceived is susceptible of numerous modifications and variations, all of which are within the scope of the appended claims. For example, the binding may be used in connection with other sports boards provided with wheels or boards usable in water sports.

All the details may further be replaced with other technically equivalent elements.

In practice, the materials used, as well as the contingent shapes and dimensions, may be any according to requirements and to the state of the art.

The disclosures in Italian Patent Application No. MI2003A001294 from which this application claims priority are incorporated herein by reference.

What is claimed is:

1. A binding for coupling a shoe to a sports board, comprising: a base plate that is fixable to a sports board; a front band; a rear band; a rear spoiler; said front and rear bands and spoiler being supported on said base plate fastenable onto a shoe; interconnection means for connecting to each other said spoiler and said front and rear bands so as to allow positioning in an open position, in which said front and rear bands are in a raised position with said rear spoiler in a lowered position for the insertion of said shoe, and to allow positioning in a closed position, in which said front and rear bands are fastened onto said shoe with said rear spoiler in the raised position, said rear spoiler comprising a quarter and a heel element that is pivoted to said base plate and is connected to a lower end of said quarter, said spoiler being actuatable to and between said lowered and raised positions, said interconnection means comprising a fastening element with ends pivoted between said rear band and said base plate, and a linkage with ends pivoted between said fastening element and said heel element whereby said rear band performing a translational motion in a combined direction that is substantially perpendicular with respect to the shoe instep region and, with a downward component direction and a component direction toward a rear part of the shoe.

2. The binding of claim 1, wherein said front band is arranged at a toe region of the shoe and said rear band is arranged at an instep region of the shoe.

3. The binding of claim 1, wherein said rear spoiler comprises a quarter and a heel element that is pivoted to said base plate and is connected to a lower end of said quarter.

4. The binding of claim 3, comprising adjustment means for adjusting the inclination of said rear spoiler.

5. The binding of claim 4, wherein said adjustment means are connected between said quarter and said heel element.

6. The binding of claim 5, comprising a base that is rigidly coupled to said rear quarter and a positioning block that is fixable in an adjustable position with respect to a plate that is rigidly associated with said heel element, said adjustment means comprising a toggle lever, which is associated between said base and said positioning black.

7. The binding of claim 1, comprising length adjustment means, arranged on said rear band, for presetting a useful length of said rear band.

8. The binding of claim 1, comprising a front presser that is associated with said front and rear bands.

9. A binding for coupling a shoe to a sports board, comprising:

a base plate that is fixable to a sports board;

a front band;

a rear band;

a rear spoiler;

said front and rear bands and spoiler being supported on said base plate fastenable onto a shoe;

interconnection means for connecting to each other said spoiler and said front and rear bands so as to allow positioning in an open position, in which said front and rear bands are in a raised position with said rear spoiler in a lowered position for the insertion of said shoe, and to allow positioning in a closed position, in which said front and rear bands are fastened onto said shoe with said rear spoiler in the raised position;

said rear spoiler comprising a quarter and a heel element that is pivoted to said base plate and is connected to a lower end of said quarter; and a fastening element, said interconnection means comprising a linkage that is articulated, at a first end thereof, to said heel element and, at a second end thereof, to a central portion of said fastening element that is pivoted, at a first end, to a corresponding shoulder of said base plate and, at a second end thereof, to an end of said rear band.

10. The binding of claim 9, wherein said interconnection means comprise a traction cable, which is provided on both sides of said base plate and is connected between an end of said heel element and the end of said front band.

11. The binding of claim 10, comprising guiding elements for said traction cable.

12. A binding for coupling a shoe to a sports board, comprising:

a base plate that is fixable to a sports board;

a front band;

a rear band;

a rear spoiler;

said front and rear bands and spoiler being supported on said base plate fastenable onto a shoe;

interconnection means for connecting to each other said spoiler and said front and rear bands so as to allow positioning in an open position, in which said front and rear bands are in a raised position with said rear spoiler in a lowered position for the insertion of said shoe, and to allow positioning in a closed position, in which said front and rear bands are fastened onto said shoe with said rear spoiler in the raised position;

said rear spoiler comprising a quarter and a heel element that is pivoted to said base plate and is connected to a lower end of said quarter; and pawls that are pushed elastically by elastic means against said heel element, said pawls comprising a tooth that is adapted to engage a complementary tooth provided at respective ends of said heel element.

13. The binding of claim 12, comprising an engagement lever that is arranged on a lateral face of said binding, for disengaging said tooth from said complementary tooth.

* * * * *